US011659969B2

(12) United States Patent
Santrizos et al.

(10) Patent No.: US 11,659,969 B2
(45) Date of Patent: May 30, 2023

(54) UNIVERSAL VACUUM-CLEANER NOZZLE

(71) Applicants: Steve Santrizos, Mooresville, NC (US); Marcus Cleff, Cologne (DE); Martin Zydek, Drolshagen (DE); Philipp Rath, Drolshagen (DE)

(72) Inventors: Steve Santrizos, Mooresville, NC (US); Marcus Cleff, Cologne (DE); Martin Zydek, Drolshagen (DE); Philipp Rath, Drolshagen (DE)

(73) Assignee: WESSEL-WERK GMBH, Reichshof-Wilbergerhuette (DE)

( * ) Notice: Subject to any disclaimer, the term of this patent is extended or adjusted under 35 U.S.C. 154(b) by 356 days.

(21) Appl. No.: 17/026,350

(22) Filed: Sep. 21, 2020

(65) Prior Publication Data

US 2021/0085140 A1 Mar. 25, 2021

(30) Foreign Application Priority Data

Sep. 23, 2019 (EP) ..... 19199024

(51) Int. Cl.
*A47L 9/06* (2006.01)
*A47L 9/00* (2006.01)

(52) U.S. Cl.
CPC ..... *A47L 9/068* (2013.01); *A47L 9/0063* (2013.01)

(58) Field of Classification Search
CPC ..... A47L 9/068; A47L 9/02; A47L 9/0693
USPC ..... 15/415.1
See application file for complete search history.

(56) References Cited

U.S. PATENT DOCUMENTS 5,113,547 A * 5/1992 Mayhew ..... A47L 11/4088 15/322
7,353,564 B2 * 4/2008 Wertz ..... A47L 9/06 15/327.5
2008/0196198 A1 * 8/2008 Labarbera ..... A47L 9/02 15/415.1
2010/0294207 A1 * 11/2010 Dyson ..... A01K 13/00 15/415.1

* cited by examiner

*Primary Examiner* — David Redding
(74) *Attorney, Agent, or Firm* — Andrew Wilford

(57) ABSTRACT

A floor nozzle for a vacuum cleaner has a housing, and a base on the housing constructed for sliding in a working direction on a floor and formed with a downwardly open slot-shaped port delimited relative to the direction between a transversely extending front port edge and a transversely extending rear port edge. The base has, extending forward from the front port edge, a part-cylindrical and downwardly convex front surface with a front radius of curvature and centered on a transversely extending symmetry axis and, extending rearward from the rear port edge, a part-cylindrical and downwardly convex rear surface having a rear radius of curvature also centered on the symmetry axis. The housing is constructed for movement of air upward through the port.

17 Claims, 2 Drawing Sheets

UNIVERSAL VACUUM-CLEANER NOZZLE

FIELD OF THE INVENTION

The present invention relates to a vacuum-cleaner nozzle. More particularly this invention concerns a multipurpose or so-called universal vacuum-cleaner floor nozzle.

BACKGROUND OF THE INVENTION

Such a nozzle typically has a housing and a sliding base on the underside of the housing. Relative to a longitudinal working direction a slot-shaped suction port extends transversely in the sliding base and is delimited by, relative to the working direction, a transverse front edge and a transverse rear edge parallel thereto.

Vacuum-cleaner floor nozzles are used to guide and shape the suction air flow of a vacuum-cleaner system on a floor surface to be cleaned. The design of a vacuum-cleaner floor nozzle is crucial for the overall cleaning performance of a vacuum-cleaning system. In the past, various types of nozzles have emerged in this area that are tailored to the particularities of different floor coverings.

A first group of floor coverings is formed by the so-called "hard floors" that have an essentially flat and air-impermeable surface. The material can vary widely, for example, these hard floors include stone and wooden floors, tiled floors and continuous floors made of plastic, such as linoleum. Since these are impermeable to air, the suction air flow must be guided completely along the floor surface. If the gap between the sliding base on the underside of a vacuum-cleaner floor nozzle and the floor surface is too small, the air resistance becomes so great that no significant volumetric flows and flow velocities can be achieved by the suction air flow. The cleaning performance drops accordingly. In such a scenario there is also an increased contact pressure of the vacuum-cleaner floor nozzle on the floor surface, since a strong negative pressure is established inside the suction port due to the difficult flow conditions. Due to the considerable contact pressure, there is intensive contact between the vacuum-cleaner nozzle and the floor surface, so that mutual damage cannot be ruled out.

To ensure sufficient suction air flow and a low contact pressure, the base of a hard floor nozzle must have a sufficient clearance from the floor surface during operation. Spacers such as bristle strips, support rollers and/or sliding surfaces are usually provided for this purpose. The base of the vacuum-cleaner nozzle is usually formed in such a way that the smallest floor clearance is achieved at the edges of the port. As the distance from the port increases, the floor clearance then increases again in order to ensure a sufficient flow toward the port. These regions where the vacuum-cleaner floor nozzle can also spread out on dirt particles arranged on the smooth floor surface are also referred to as so-called "slide inclines."

Vacuum-cleaner floor nozzles can also be optimized for use on textile floor coverings or carpets. The suction air flow that only remains on the surface is not sufficient to clean it. At least a certain proportion of the suction air must therefore pass through the textile flooring material or carpet. For this application scenario, the underside of the vacuum-cleaner nozzle is formed as a sliding base that is designed for flat contact with the floor. In this case, regions of the sliding base that are as flat as possible lie flat on the textile flooring material and thus allow the vacuum-cleaner floor nozzle to slide over them. The large contact surface also helps to ensure that only some of the air flow passes between the floor surface and the vacuum-cleaner nozzle while most of it passes through the textile flooring material. There, the suction air flow can loosen and remove embedded dirt particles.

The technical challenge is to manufacture vacuum-cleaner nozzles that can adequately address both applications. This is usually ensured by an adjustment mechanism with which the floor clearance of a sliding base can be adjusted mechanically. The clearance for vacuuming textile floor coverings is reduced, while smooth floors can be vacuumed with an increased floor clearance. On the one hand, such solutions require increased design and material costs because an appropriate adjustment mechanism has to be implemented and integrated into a vacuum-cleaner floor nozzle. At the same time, a user has to switch vacuum-cleaner floor nozzles of this type in the majority of cases by manual interaction between a smooth floor position and a carpet floor position as required. This creates additional operating effort.

OBJECTS OF THE INVENTION

It is therefore an object of the present invention to provide an improved vacuum-cleaner floor nozzle.

Another object is the provision of such an improved vacuum-cleaner floor nozzle that overcomes the above-given disadvantages, in particular that can be used on smooth floors as well as on textile floor coverings without an explicit adjustment mechanism. In particular, intensive cleaning of carpets should be made possible.

SUMMARY OF THE INVENTION

A floor nozzle for a vacuum cleaner has according to the invention a housing and a base on the housing constructed for sliding in a working direction on a floor and formed with a downwardly open slot-shaped port delimited relative to the direction between a transversely extending front port edge and a transversely extending rear port edge. The base has, extending forward from the front port edge, a part-cylindrical and downwardly convex front surface with a front radius of curvature and centered on a transversely extending symmetry axis and, extending rearward from the rear port edge, a part-cylindrical and downwardly convex rear surface having a rear radius of curvature also centered on the symmetry axis. The housing is constructed for movement of air upward through the port.

The floor-engaging slide surface of the vacuum-cleaner floor nozzle according to the invention nozzle that is designed in portions as a cylinder jacket, allows stepless pivoting about the axis of symmetry, contact with the floor being continuously ensured by the front surface and/or the rear surface. In contrast to the slide inclines, floor contact is ensured in a linear region of approximately the same size extending transversely. The sealing effect is therefore independent of the pivot angle According to a preferred embodiment, the front port edge is spaced from the axis of symmetry by the front radius and the rear port edge from the axis of symmetry by the rear radius. The front port edge and the rear port edge thus directly connect to the respective front and rear surfaces. The pivoting movement about the axis of symmetry is therefore not disturbed by the formation of the port edges. It is also possible to bring the front edge of the port or the rear edge of the port into direct contact with the floor by setting a specific tilt angle. The floor surface is preferably tangential to the front or rear surface.

At the edge of the port, the vacuum-cleaner nozzle is set back into the interior of the housing extending from the adjacent sliding surface. Preferably, to the port edges form an angle of at most 90°, preferably at most 60°, in particular at most 45° with the tangent to the adjacent surface. The suction passage wall forms with the adjoining part-cylindrical surface an angular or wedge-shaped projection that can extend well into textile material and move fibers of the textile floor covering via mechanical interaction.

When rolling over the front part-cylindrical surface or the rear part-cylindrical surface, a position can be reached in which the front port edge or the rear port edge engages the underlying floor surface. In this position, a floor covering in particular a textile floor covering, can be worked particularly intensively with the edges of the port.

Such mechanical interaction can loosen dirt particles embedded in the textile floor covering so that they can be aspirated by the suction air flow. In the case of impervious hard floor coverings, the edges of the port can also be used to loosen dirt that adheres to them.

Expediently, the port edges can be positioned by appropriately aligning the nozzle housing so that the particular port edge that is positioned on a working stroke (forward or rearward) on the side opposite the direction of movement is in contact with the floor. An air gap is thus formed at the front edge in the direction of movement through which the suction air flow can enter and also dirt particles on the floor covering are not "pushed away." At the same time, the edge of the port trailing rear in the direction of movement comes into contact with the floor in order to increase this cleaning effect.

According to a preferred embodiment, the front port edge and the rear port edge are straight and parallel to one another. In particular, the front edge of the port and the rear edge of the port run exactly transversely. As a result, the respective edge of the port comes into contact with the floor surface to be cleaned at a specific tilt angle. Complete processing is thus achieved across the entire port width.

In an alternative embodiment, only one of the two port edges, in particular the rear port edge, is straight and extends exactly transversely. This can then be used as a loosening instrument for a forward stroke of the vacuum-cleaner floor nozzle so that additional contact pressure can be exerted by the operator. By contrast, the front edge of the port runs at a spacing of the front radius about the axis of symmetry, but in this case has a curvature oriented in the tangential direction. As a result, the air gap formed between the curvature and the floor surface and thus the amount of air entering via the front edge of the port can be regulated by selecting the working angle of the vacuum-cleaner floor nozzle. This means that the cleaning conditions can be precisely set by simply selecting the working angle, in particular on soft textile coverings into which the vacuum-cleaner floor nozzle can sink. At the same time, this influences the amount of air entering via the front edge of the port and also the degree of mechanical interaction between the rear edge of the port and the textile floor covering.

According to a particularly preferred embodiment, the front radius and the rear radius are the same. As a result, the front surface and the rear surface are geometrically on the same surface, so that a seamless rolling from the rear part-cylindrical surface onto the front part-cylindrical surface and vice versa is possible. The front radius and the equally large rear radius can also be referred to as "the radius" for short.

According to a particularly preferred embodiment, the port is delimited at transverse ends by side walls. The two side walls each have a lower end edge that is spaced from the axis of symmetry by an amount greater than or equal to the front radius and greater than or equal to the rear radius. The side walls thus act as spacers that, when pivoting from the front surface to the rear surface or vice versa, prevent both port edges from coming into contact with the floor surface at the same time. This reliably prevents the vacuum-cleaner nozzle from adhering to hard floors.

The side walls are preferably narrow transversely, in particular with a width of less than 5 mm. Such narrow side walls allow sinking into a textile floor covering, so that there is simultaneous floor contact between the front edge of the port and the rear edge of the port. In addition, the portions of the side walls sunk into the carpet or rug provide additional sealing, so that the incoming suction air flow is concentrated on the front edge of the port and the rear edge of the port.

According to a particularly preferred embodiment, the lower end edges extend longitudinally perpendicular to the transverse direction as circular arcs with a third radius of curvature and centered on about the symmetry axis. The combination of the front surface, side walls and rear surface allow a continuous and transition-free tilting or rolling movement.

In this case, the lower end edges preferably each connect aligned with the front surface and the rear surface.

According to an alternative embodiment, the lower end edges each have an overhang of between 1 mm and 3 mm with respect to the front radius and the rear radius. In this embodiment, the front edge of the port and/or the rear edge of the port are each raised on smooth floors by at least the amount of the projection, so that there is no direct, continuous contact with the floor. This ensures that there is always a minimal suction air gap both from the front and from the rear, even on smooth floors. In this variant, the lower end edges of the side walls can particularly preferably be extended by radially projecting collars at the ends of the part-cylindrical surfaces.

In order to achieve the best possible cleaning result, the port extends transversely with a port width preferably essentially over the entire width of the contact surface of the vacuum nozzle (working width). In particular, the port width accounts for at least 95%, particularly preferably at least 97%, of the working width.

Likewise, the front surface and/or the rear surface preferably extend transversely over essentially the entire width of the port. In particular, they extend over at least 95%, in particular at least 99%, of the port width.

In order to ensure rolling over the part-cylindrical surfaces, there is preferably no portion of the sliding base over the two part-cylindrical surfaces in the vertical direction below.

According to a preferred embodiment, the front edge of the port is arranged at least 3°, preferably at least 5°, forward in relation to a vertical plane that is perpendicular to the working direction and runs through the axis of symmetry. Alternatively or additionally, the rear port edge is arranged at least 3°, preferably at least 5°, to the rear starting from the vertical plane. This ensures that a significant pivoting movement that is controllable and perceptible for the user is required for pivoting the front port edge to the rear port edge from contact with the floor. At the same time, a sufficient size of the port for generating sufficiently large suction air flows is ensured.

Likewise, it is preferably provided that the front port edge is arranged forward by no more than 10° relative to the vertical plane and that the rear port edge is arranged rearward by no more than 10° relative to the vertical plane. This ensures that the pivoting movements required for switching are kept low enough during operation to ensure usability.

In order to provide a sufficient contact surface with a large pivot range, the front surface and/or the rear surface extends over at least 30°, preferably at least 45°, starting from the vertical plane forward or rearward.

According to a preferred variant of the invention, the front port edge and rear port edge symmetrically flank the vertical plane. This creates a natural feeling of operation for the user and intuitive handling is made possible.

Likewise, the front surface and the rear surface are formed symmetrically with respect to the vertical plane at least in a central region with respect to the transverse direction, in particular over the entire width.

The concept according to the invention works particularly well if the front radius and the rear radius are at least 3 cm. It is also preferably provided that the front radius below rear radius are no more than 8 cm. In the preferred range of curvature, the only slightly curved part-cylindrical surfaces produce a sufficient sealing effect on compressible textile floor coverings. At the same time, a sufficient vertical stroke of the port edges can be generated with relatively small pivoting movements in order to specifically control the suction air flow.

For handling the vacuum-cleaner floor nozzle according to the invention, a suction connection piece preferably comprising an angled part is part of the housing and is held on the housing only pivotably about an axis of rotation. The axis of rotation that is fixed in relation to the housing allows the user to precisely control the working angle of the vacuum-cleaner floor nozzle relative to the floor surface by raising or lowering the suction connection piece—usually via a suction hose coupled thereto. Due to the angled design of the suction connection piece in connection with the pivotability, the user can at the same time bring about a steering effect on the vacuum-cleaner floor nozzle—by pivoting the suction tube about its longitudinal axis.

The axis of rotation is in particular aligned perpendicular to the transverse direction and is within a longitudinal center plane of the vacuum-cleaner nozzle. The axis of rotation is particularly preferably slightly inclined by no more than 20° in the working direction (i.e. horizontally) or with respect to the working direction. In particular, the axis of rotation forms an angle with the vertical plane of between 90° and 110°, particularly preferably approximately 100°. The point of intersection of the axis of rotation with the vertical plane is preferably above the axis of symmetry. This allows particularly good handling and control action. According to a preferred variant, the longitudinal axis of the angled portion is inclined at the suction connection piece by at least 30° with respect to the axis of rotation. This ensures sufficient control about the vertical axis (vertical direction) of the vacuum nozzle.

According to a particularly preferred embodiment, the housing of the vacuum-cleaner floor nozzle is constructed in a plurality of parts, the suction connection piece being on an upper housing part and the upper housing part being detachably connected to a lower housing part comprising the sliding base.

The sliding base can also preferably be attached as a housing upper part to a conventional vacuum-cleaner floor nozzle as a functional module forming the housing lower part.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
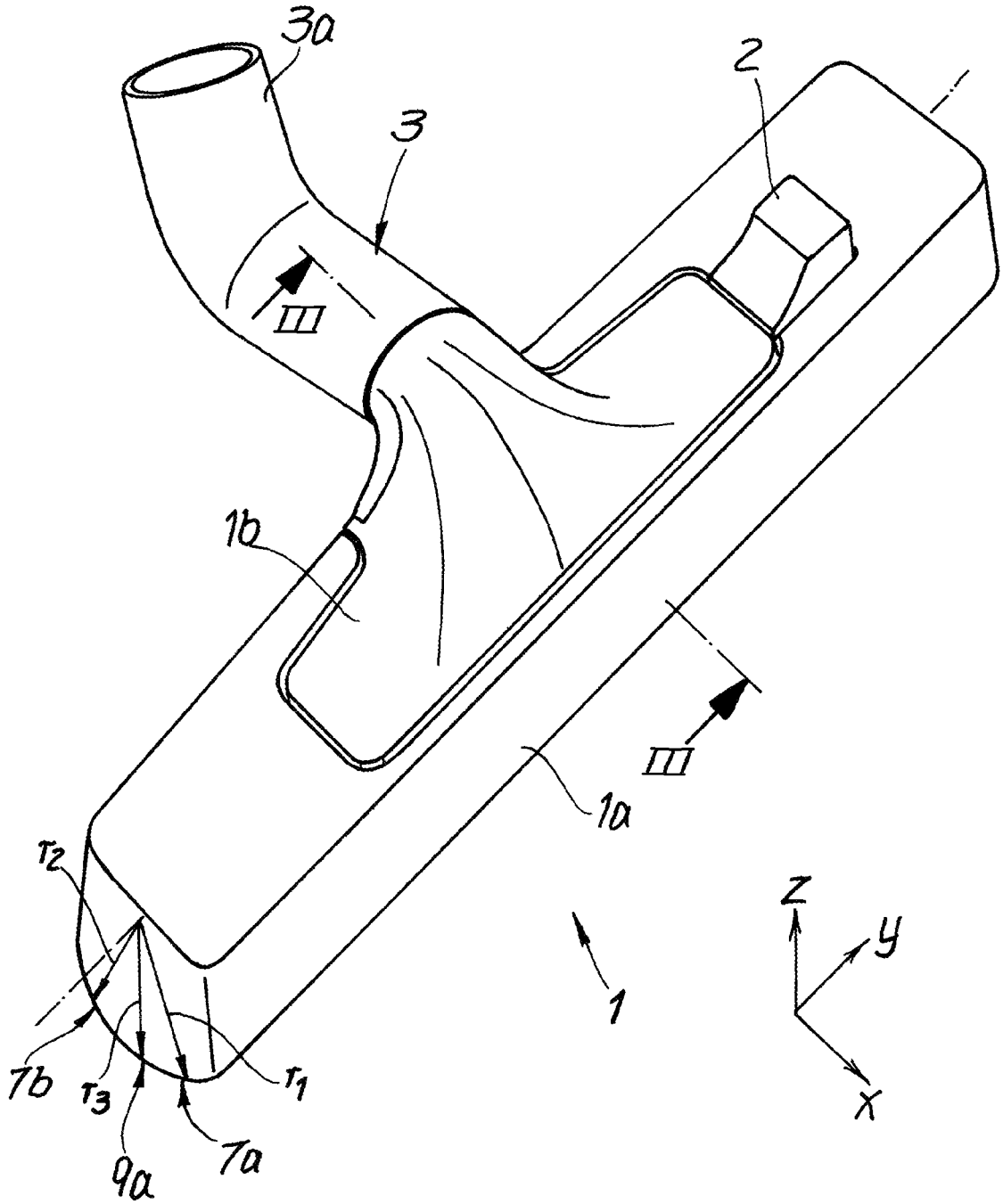
FIG. 1 is a perspective view of a vacuum-cleaner nozzle according to the invention.

As seen in FIG. 1, a vacuum-cleaner nozzle 1 according to the invention has a lower housing part 1*a* and an upper housing part 1*b* releasably connected thereto. The releasable connection between the lower part 1*a* and the upper part 1*b* is controlled by a locking button 2 that locks the upper part 1*b* to the lower part 1*a* during normal use, but that allows the lower part 1*a* to be switched with other implements, for example a power brush. At the rear end of the upper part 1*b*, a suction connection piece 3 is pivotably attached to an angled portion 3*a* at the rear to an unillustrated suction hose.

Figure 2:
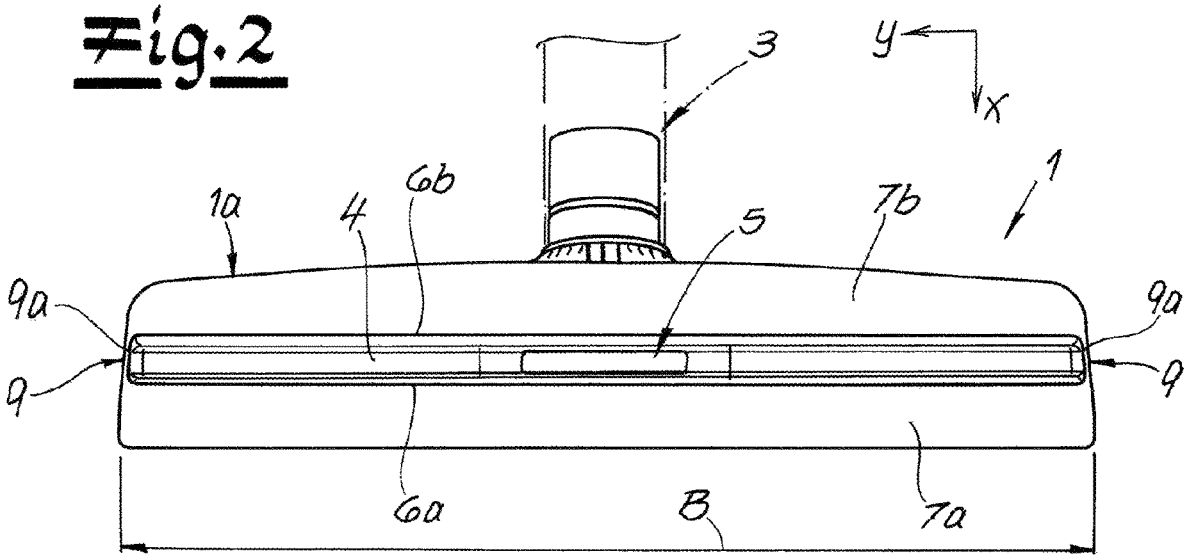
FIG. 2 is a bottom view of the nozzle.

FIG. 2 shows that a transversely elongated slot-shaped port 4 is formed on the underside of the lower part 1*a* and extends in a transverse direction y that is perpendicular to a working direction x over substantially an entire width B of the vacuum-cleaner nozzle 1.

The port 4 communicates with the suction connection piece 3 via a flow passage 5. The port 4 is delimited in the working direction x by a front port edge 6*a* and a rear port edge 6*b*. In the illustrated embodiment, both the front port edge 6*a* and the rear port edge 6*b* are linear and run parallel to one another transversely y.

Figure 3:
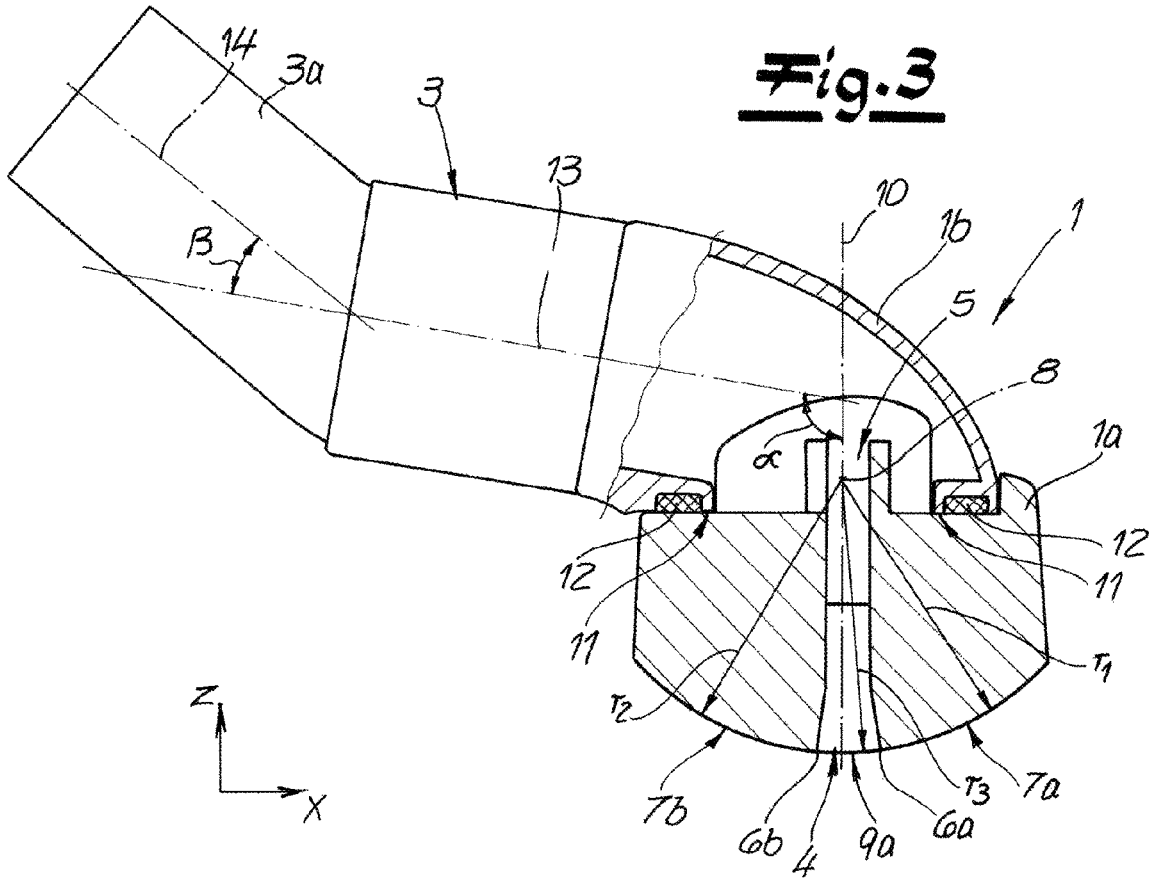
FIG. 3 is a side view of the nozzle partly in vertical section along line of FIG. 1.

The underside of the lower part or base 1*a* is formed with a front part-cylindrical surface 7*a* that is downwardly convex and directly forward of the front port edge 6*a* and a rear part-cylindrical surface 7*b* that is also downwardly convex and directly rearward of rear port edge 6*b*. FIG. 3 shows that the front part-cylindrical surface 7*a* has a front radius $r_1$ of curvature and the rear part-cylindrical surface 7*b* has a rear or rear radius $r_2$ of curvature, with both surfaces 7*a* and 7*b* centered on a common axis of symmetry 8 extending transversely y.

In the illustrated embodiment, the front radius $r_1$ and the rear radius $r_2$ are of the same size. As a result, the front surface 7*a* and the rear surface 7*b* can be viewed geometrically as part of the same cylindrical outer surface.

The figures also show that the port 4 transversely y is closed at its ends by side walls 9 each having a lower end edge 9*a* that extends generally in the working direction x as a circular arc about the axis of symmetry with a third radius $r_3$ of curvature. Here the third radius $r_3$ is of the same size as the front and rear radii $r_1$ and $r_2$.

Furthermore, the axis of symmetry 8 is extends vertically in the direction z in the passage 5 above the port 4, but offset to the rear in the working direction x. This moves the center of rotation of the nozzle to the rear that simplifies handling during operation, so that when sitting on the floor with the passage vertical, the port 4 is open toward the front to aspirate dust and the like.

The detailed sectional view according to FIG. 2, shows that the front surface 7*a* extends forward from the axis of symmetry 8 and a vertical plane 10 extending therethrough and perpendicular to the working direction x through an angle of approximately 45°. The front port edge 6*a* that rearwardly bounds the front surface 7*a* is offset approximately 10° to the front. In contrast, the rear surface 7*b* extends from the rear port edge 6*b* and is offset approximately 5° to the rear, over an angle of likewise 45°. The sliding base thus spans a quarter circle of 90°.

In section, it can also be seen that the separately and detachably formed upper part 1*b* is designed as an independent vacuum-cleaner nozzle with its own sliding surface 11 and thread-lifting strips 12. The upper part 1*b* can thus be used as an independent vacuum-cleaner nozzle after being detached from the lower part 1*a*. The contact plane of the sliding surface 11 is oriented perpendicular to the vertical direction y or to the vertical plane 10.

It can also be seen from FIG. 3 that the suction connection piece 3 is held on the upper part 1*b* such that it can pivot about an axis of rotation 13 running perpendicular to the transverse direction y and inclined with respect to the working direction x. In the illustrated embodiment, the angle α between the axis of rotation 13 and the vertical plane 10 is approximately 100°. The angled portion 3*a* with its longitudinal extension 14 extends an angle β of approximately 30° to the rotation axis 13.

We claim:

1. A floor nozzle for a vacuum cleaner, the nozzle comprising:

a housing; and a base on the housing constructed for sliding in a working direction on a floor and formed with a downwardly open slot-shaped port delimited relative to the direction between a transversely extending front port edge and a transversely extending rear port edge, the base having, extending forward from the front port edge, a part-cylindrical and downwardly convex front surface with a front radius of curvature and centered on a transversely extending symmetry axis and, extending rearward from the rear port edge, a part-cylindrical and downwardly convex rear surface having a rear radius of curvature also centered on the symmetry axis, the housing being constructed for movement of air upward through the port, the housing having transversely spaced end walls closing transverse ends of the port and each having a lower end edge extending generally parallel to the direction between respective ends of the front and rear port edges, each lower end edge being spaced from the symmetry axis by a distance equal at least to the front or rear radius.

2. The floor nozzle according to claim 1, wherein the front port edge is spaced by the front radius from the axis and the rear port edge is spaced by the rear radius from the axis.

3. The floor nozzle according to claim 1, wherein the port edges are straight and parallel.

4. The floor nozzle according to claim 1, wherein the front radius and the rear radius are of identical lengths.

5. The floor nozzle according to claim 1, wherein the lower end edges are downwardly concave part-circular arcs with centers of curvature at the symmetry axis.

6. The floor nozzle according to claim 5, wherein the lower end edges meet at the front and rear port edges flush with the front and rear surfaces.

7. The floor nozzle according to claim 5, wherein the lower end edges project downward by 1 mm to 3 mm past the front and rear surfaces.

8. A floor nozzle for a vacuum cleaner, the nozzle comprising:

a housing; and a base on the housing constructed for sliding in a working direction on a floor and formed with a downwardly open slot-shaped port delimited relative to the direction between a transversely extending front port edge and a transversely extending rear port edge, the base having, extending forward from the front port edge, a part-cylindrical and downwardly convex front surface with a front radius of curvature and centered on a transversely extending symmetry axis and, extending rearward from the rear port edge, a part-cylindrical and downwardly convex rear surface having a rear radius of curvature also centered on the symmetry axis, the housing being constructed for movement of air upward through the port, each of the front and rear edges being offset by an angle of at least 3° from the symmetry plane relative to a vertical plane extending through the axis and between the front and rear edges.

9. The floor nozzle according to claim 8 wherein the angle of the front port edge is offset more than 10° from the vertical plane, and the rear edge is offset by less than 10° from the vertical plane.

10. The floor nozzle according to claim 8, wherein the front surface and/or the rear surface have an arc length of at least 30° measured from the vertical plane.

11. The floor nozzle according to claim 8, wherein the front and rear port edges symmetrically flank the vertical plane.

12. The floor nozzle according to claim 11, wherein the front and rear surfaces symmetrically flank the vertical plane.

13. The floor nozzle according to claim 1, wherein each of the radii is at least 3 cm long.

14. The floor nozzle according to claim 1, wherein each of the radii is at most 8 cm long.

15. The floor nozzle according to claim 1, wherein the housing includes a rear portion configured for connection to a vacuum hose and a rear portion carrying the base and pivotal on the rear portion.

16. The floor nozzle according to claim 15, wherein the front portion rotates relative to the rear portion about an axis lying in a vertical plane perpendicular to the symmetry axis.

17. The floor nozzle according to claim 8, wherein the housing has transversely spaced end walls closing transverse ends of the port and each having a lower end edge extending generally parallel to the direction between respective ends of the front and rear port edges, each lower end edge being spaced from the symmetry axis by a distance equal at least to the front or rear radius.

* * * * *